US009046803B2

(12) United States Patent
Hoshio et al.

(10) Patent No.: US 9,046,803 B2
(45) Date of Patent: Jun. 2, 2015

(54) CHARGING ROLL, CHARGING UNIT, PROCESS CARTRIDGE, IMAGE FORMING APPARATUS, AND METHOD OF MANUFACTURING CHARGING ROLL

(71) Applicant: FUJI XEROX CO., LTD., Tokyo (JP)

(72) Inventors: Takuro Hoshio, Kanagawa (JP); Taketoshi Hoshizaki, Kanagawa (JP); Shoichi Masuda, Kanagawa (JP); Eiichi Iida, Kanagawa (JP); Takahiko Hattori, Kanagawa (JP); Noboru Wada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/182,849

(22) Filed: Feb. 18, 2014

(65) Prior Publication Data

US 2015/0050052 A1 Feb. 19, 2015

(30) Foreign Application Priority Data

Aug. 14, 2013 (JP) ..... 2013-168659

(51) Int. Cl.
*G03G 15/02* (2006.01)
*B05D 1/26* (2006.01)

(52) U.S. Cl.
CPC ..... *G03G 15/0216* (2013.01); *B05D 1/265* (2013.01); *B05D 2506/20* (2013.01)

(58) Field of Classification Search
CPC ..... G03G 15/0216
USPC ..... 399/168, 174, 175, 176, 313
See application file for complete search history.

(56) References Cited

U.S. PATENT DOCUMENTS

| | | | | |
|---|---|---|---|---|
| 2011/0002711 | A1* | 1/2011 | Wada | 399/176 |
| 2013/0004205 | A1* | 1/2013 | Gilmartin et al. | 399/176 |
| 2013/0105850 | A1* | 5/2013 | Komatsu et al. | 257/98 |

FOREIGN PATENT DOCUMENTS

| | | |
|---|---|---|
| JP | B1-3118639 | 12/2000 |
| JP | A-2006-208447 | 8/2006 |
| JP | B2-4731914 | 7/2011 |

* cited by examiner

*Primary Examiner* — Sandra Brase
(74) *Attorney, Agent, or Firm* — Oliff PLC

(57) ABSTRACT

A charging roll includes a cylindrical base member that has a metal-containing surface, a conductive adhesive layer that includes a halogen atom-containing resin and has surface roughness Rz in a range of 0.5 μm to 8 μm on an outer peripheral surface side on the base member, and a conductive elastic layer that is disposed to be brought into contact with the outer peripheral surface of the conductive adhesive layer and includes a halogen atom-containing rubber.

15 Claims, 6 Drawing Sheets

CHARGING ROLL, CHARGING UNIT, PROCESS CARTRIDGE, IMAGE FORMING APPARATUS, AND METHOD OF MANUFACTURING CHARGING ROLL

CROSS-REFERENCE TO RELATED APPLICATIONS

This application is based on and claims priority under 35 USC 119 from Japanese Patent Application No. 2013-168659 filed Aug. 14, 2013.

BACKGROUND

1. Technical Field

The present invention relates to a charging roil, a charging unit, a process cartridge, an image forming apparatus, and a method of manufacturing the charging roll.

2. Related Art

In electrophotographic image forming apparatuses, first, a charge is formed using a charging unit on a surface of an image holding member such as a photoconductive photoreceptor including an inorganic or organic material to form an electrostatic latent image by laser light or the like obtained by modulating an image signal, and then the electrostatic latent image is developed with a charged toner to form a visualized toner image. The toner image is electrostatically transferred to a recording medium such as recording paper either directly or via an intermediate transfer medium, and is fixed to the recording medium to obtain a reproduced image.

A charging roll is suitably used as the charging unit that charges the stir face of the image holding member.

SUMMARY

According to an aspect of the invention, there is provided a charging roll including:

a cylindrical base member that has a metal-containing surface;

a conductive adhesive layer that includes a halogen atom-containing resin and has surface roughness Rz in a range of 0.5 μm to 8 μm on an outer peripheral surface side on the base member; and a conductive elastic layer that is disposed to be brought into contact with the enter peripheral surface of the conductive adhesive layer and includes a halogen atom-containing rubber.

BRIEF DESCRIPTION OF THE DRAWINGS

Exemplary embodiments of the present invention will be described in detail based on the following figures, wherein.

DETAILED DESCRIPTION

Figure 1:
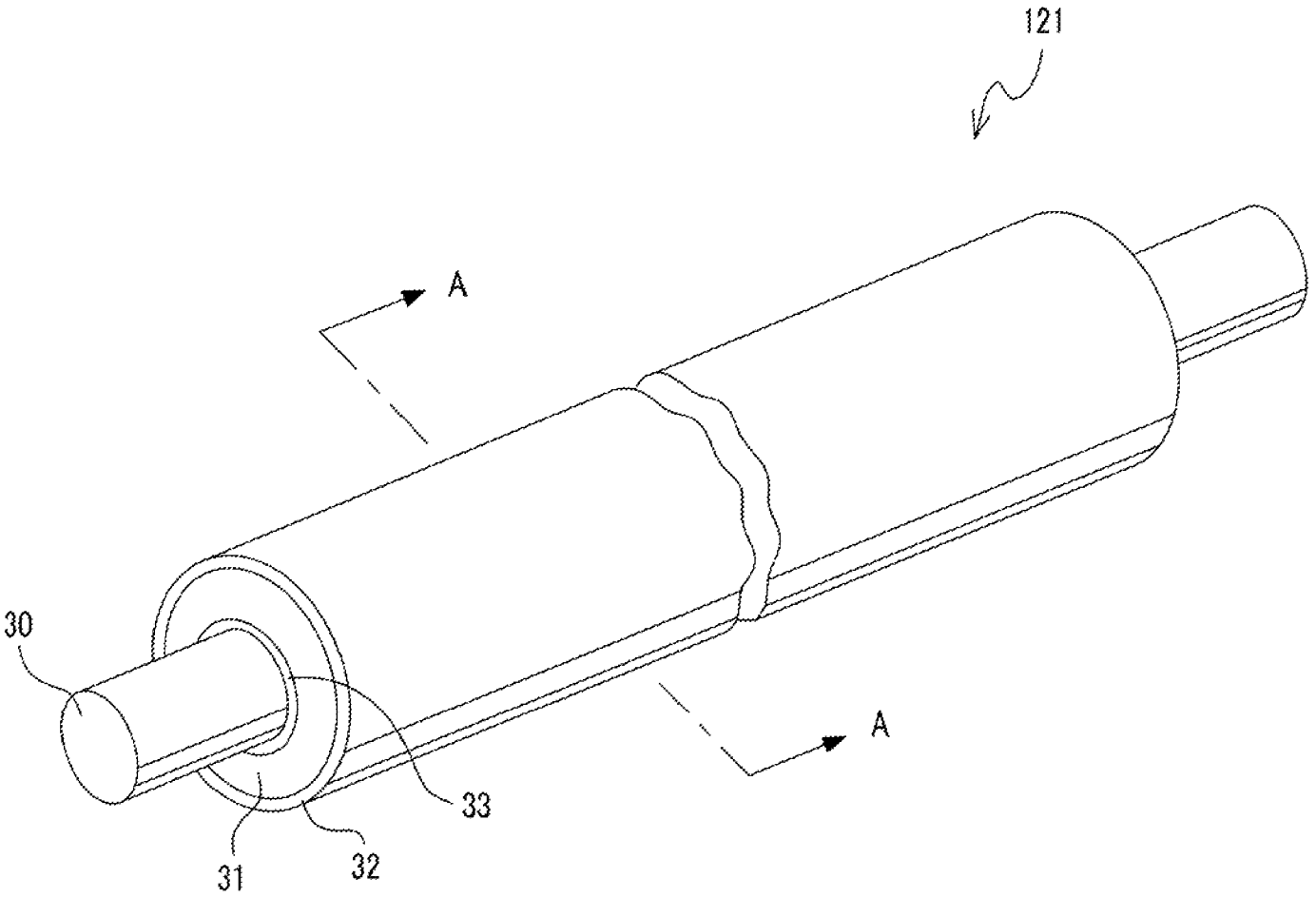
FIG. 1 is a perspective view schematically illustrating a charging roll according to an exemplary embodiment of the invention.

Hereinafter, exemplary embodiments of the invention will be described in detail.

Charging Roll

A charging roll according to an exemplary embodiment has a cylindrical base member that has a metal-containing surface, a conductive adhesive layer (hereinafter, also simply referred to as "adhesive layer") that includes a halogen atom-containing resin and has surface roughness Rz in a range of 0.5 μm to 8 μm on an outer peripheral surface side on the base member, and a conductive elastic layer (hereinafter, also simply referred to as "elastic layer") that is disposed to foe brought into contact with the cater peripheral surface of the conductive adhesive layer and includes a halogen atom-containing rubber.

Hitherto, as a charging roll for charging a member to be charged by being brought into contact with a surface of the member to be charged, a roll in which a conductive adhesive layer and a conductive elastic layer are laminated on a cylindrical base member is used. However, the elastic layer may be peeled from the adhesive layer, and thus excellent adhesion maintainability is required between the elastic layer and the adhesive layer.

However, dimensional stability may be reduced when just using an adhesive having high adhesiveness. Specifically, as a method of forming an elastic layer on a base member having an adhesive layer provided in advance, a method of forming an elastic layer on a surface of the adhesive layer on the base member through, extrusion molding is performed. However, the surface of the adhesive layer may be scratched during the extrusion molding, and the scratches caused on the adhesive layer directly lead to a reduction in dimensional accuracy of the charging roll. The reduction in dimensional accuracy occurs not only in a case using the extrusion molding method, for example, but also in a case of a method of forming an elastic layer on a surface of an adhesive layer through injection molding.

That is, a charging roll that achieves both of excellent adhesiveness between the elastic layer and the adhesive layer and dimensional stability, that are inconsistent with each other, is required.

Regarding this, the charging roll according to this exemplary embodiment has the adhesive layer that includes a halogen atom-containing resin and has surface roughness Rz within the above range on the outer peripheral surface side, and the elastic layer that includes a halogen atom-containing rubber. Thus, the charging roll is excellent in adhesiveness between the elastic layer and the adhesive layer, in adhesion maintainability, and in dimensional accuracy.

The mechanism behind this effect being achieved is not necessarily clear, but is presumed as follows. That is, it is considered that when the surface roughness Rz on the outer peripheral surface side of the adhesive layer is controlled to be within the above range, the resistance to scratches for the case in which the elastic layer is formed on the surface of the adhesive layer is improved, and as a result, a charging roll having excellent dimensional accuracy is provided.

In order to adjust the surface roughness of the adhesive layer, it is necessary to adjust the amounts of a material of an adhesive that is used in the adhesive layer and other additives, the particle diameters of the additives, or the like, and nigh adhesiveness is not easily obtained since a degree of freedom of material selection is restricted. However, in this exemplary embodiment, it is considered that since the adhesive layer includes a halogen atom-containing resin and the elastic layer includes a halogen atom-containing rubber, the polarities of the adhesive layer and the elastic layer become closer to each other, whereby the adhesiveness therebetween is improved and the good adhesiveness is maintained. As a result, both of the excellent adhesiveness between the elastic layer and the adhesive layer and the dimensional stability, that are inconsistent with each other, are presumed to be achieved.

Surface Roughness Rz

In this exemplary embodiment, the surface roughness Rz on the outer peripheral surface side of the adhesive layer is in a range of 0.5 μm to 8 μm. When is greater than the above upper limit value, scratches are caused when the elastic layer is formed on the surface of the adhesive layer, and as a result, a charging roll having excellent dimensional accuracy is not obtained. On the other hand, when Rz is less than the above lower limit value, the surface has irregularities after the formation, and as a result, a charging roll having excellent dimensional accuracy is not obtained.

The surface roughness Rz on the outer peripheral surface side of the adhesive layer is preferably in a range of 1 μm to 8 μm, and more preferably in a range of 1 μm to 5 μm.

The surface roughness Rz on the outer peripheral surface side of the adhesive layer is measured using the following method, after the outer peripheral surface of the adhesive layer is exposed by forcibly peeling-off a layer (the elastic layer or the like) that is closer to the outer periphery than the adhesive layer in the charging roll.

The measurement is performed using a surface roughness meter surfcom 1400A (manufactured by Tokyo Seimitsu Co., Ltd.) in accordance with JIS B0601-1994. The measurement is performed under the environment of 22° C. and 55% RH.

The surface roughness Rz of the adhesive layer is adjusted by selecting a material of an adhesive that is used in the adhesive layer, by selecting the kind of an additive such as a conducting agent, by adjusting a particle diameter or an amount of the additive, ox the like.

Friction Coefficient (Static Friction Coefficient) of Adhesive Layer

In this exemplary embodiment, a friction coefficient on the outer peripheral surface side of the adhesive layer is preferably in a range of 0.2 to 0.9. When the friction coefficient is equal to or greater than the above lower limit value, the resistance to scratches for the case in which the elastic layer is formed on the surface of the adhesive layer is improved, and as a result, a charging roll having excellent dimensional accuracy is provided. On the other hand, when the friction coefficient is equal to or less than the above upper limit value, the generation of irregularities on the surface after the formation is suppressed, and as a result, a charging roll having excellent dimensional accuracy is provided.

The friction coefficient on the outer peripheral surface side of the adhesive layer is preferably in a range of 0.3 to 0.8, and more preferably in a range of 0.4 to 0.7.

The friction coefficient (static friction coefficient) on the outer peripheral surface side of the adhesive layer is measured using the following method after the outer peripheral surface of the adhesive layer is exposed by forcibly peeling-off a layer (the elastic layer or the like) that is closer to the outer periphery than the adhesive layer in the charging roll.

The static friction coefficient is measured using a method based on ASTM-D-1894.

The friction coefficient of the adhesive layer is adjusted by selecting a material of an adhesive that is used in the adhesive layer, by controlling a coating condition and a drying condition of the adhesive or a solvent that dilutes the adhesive, or the like.

Difference in SP Value

In this exemplary embodiment, the difference in SP value between the halogen atom-containing resin that is contained in the adhesive layer and the halogen atom-containing rubber that is contained in the elastic layer is preferably 5 or less, more preferably 3 or less, and still more preferably 2 or less.

It is considered that when the difference in SP value between the resin and the rubber is within the above range, the polarities of the adhesive layer and the elastic layer become closer to each other, and thus the adhesiveness therebetween is improved and the good adhesiveness is maintained.

Although not particularly limited, the lower limit value of the difference in SP value is preferably 0.01 or greater.

The SP values of the halogen atom-containing resin that is contained in the adhesive layer and the halogen atom-containing rubber that is contained in the elastic layer are calculated using a method of obtaining an estimate based on the Fedors method.

The SP values of the halogen atom-containing resin and the halogen atom-containing rubber are adjusted by selecting the kind of the halogen atoms of each of the resin and the rubber, by adjusting a halogenation rate, or the like.

Hereinafter, the configuration of the charging roll will be described in detail.

Figure 2:
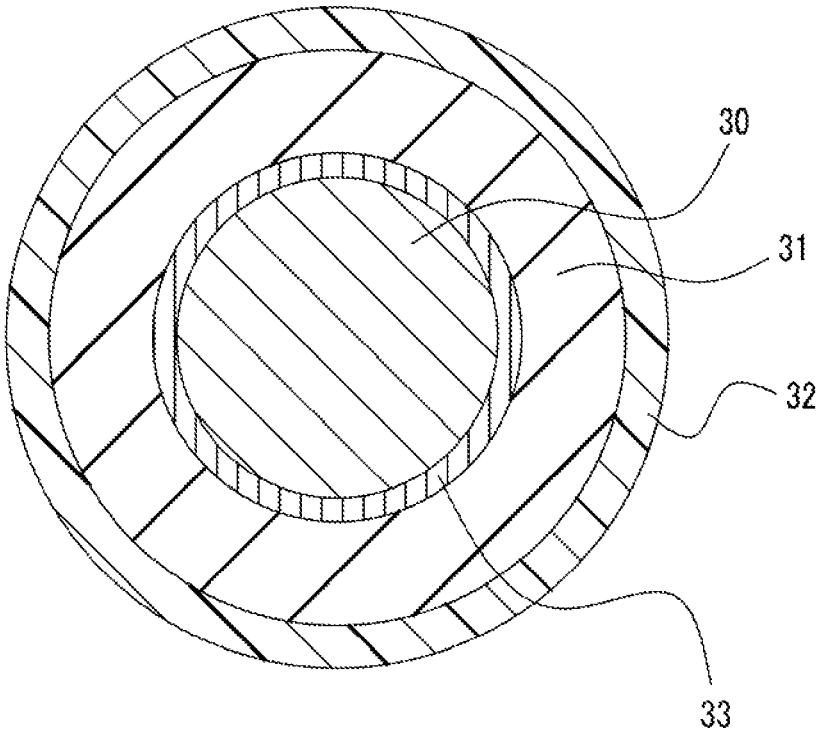
FIG. 2 is a cross-sectional view schematically illustrating the charging roll according to the exemplary embodiment of the invention.

FIG. 1 is a perspective view schematically illustrating an example of the charging roll according to this exemplary embodiment. FIG. 2 is a cross-sectional view schematically illustrating the charging roll shown in FIG. 1. FIG. 2 is a cross-sectional view taken along the line A-A of FIG. 1.

As shown in FIGS. 1 and 2, a charging roll 121 according to this exemplary embodiment is a roll member having a cylindrical base member (shaft) 30, an adhesive layer 33 that is disposed on an outer peripheral surface of the base member 30, and a conductive elastic layer 31 that is disposed to be brought into contact with an outer peripheral surface of the adhesive layer 33. A conductive outermost layer 32 may be disposed on an outer peripheral surface of the conductive elastic layer 31.

The charging roll 121 according to this exemplary embodiment is not limited to the configuration, and may have a configuration including, for example, a resistance adjusting layer or a transition preventing layer disposed between the conductive elastic layer 31 and the conductive outermost layer 32 or a coating layer (protective layer) disposed ors the outer surface (the outermost surface) of the conductive outermost layer 32.

In this specification, "conductivity" means that the volume resistivity at 20° C. is less than $1\times10^{13}$ Ωcm.

Base Member

The base member 30 will be described below.

In this exemplary embodiment, the base member 30 is a cylindrical base member that has a metal-containing surface.

The base member 30 is formed of a metal or alloy such as aluminum, copper alloy, and stainless steel; iron plated with chromium, nickel, or the like; and a conductive material such as a conductive resin.

The base member 30 serves as an electrode and a support member of the charging roll. Examples of the material of the base member include metal such as iron (such as free-cutting steel), copper, brass, stainless steel, aluminum, and nickel. In this exemplary embodiment, the base member 30 is a rod-like conductive member. Members (such as resin or ceramic members) having the outer peripheral surface plated or members (such as resin or ceramic members) in which a conducting agent is dispersed may be used as the base member 30. The base member 30 may be a hollow member (tubular member) or a non-hollow member.

Adhesive Layer

The adhesive layer 33 is a layer that adheres the conductive elastic layer 31 and the base member 30 to each other, and includes a halogen atom-containing resin. The surface roughness Rz on the outer peripheral surface side thereof is in a range of 0.5 μm to 8 μm.

Adhesive: Halogen Atom-Containing Resin

In the adhesive layer 33, a halogen atom-containing resin is used as an adhesive from the viewpoint of improving the adhesiveness and the adhesion maintainability between the elastic layer and the adhesive layer.

In this exemplary embodiment, the difference in SP value between the halogen atom-containing resin that is contained in the adhesive layer and the halogen atom-containing rubber that is contained in the elastic layer is preferably 2 or less.

Examples of the halogen atoms include F, Cl, Br, I, and At. Among these, a resin containing Cl, F, and Br atoms is preferably used, and a resin containing chlorine atoms is more preferably used.

In the chlorine atom-containing resin, a chlorination rate is preferably in a range of 18% to 23%, more preferably in a range of 13% to 22%, and still more preferably in a range of 20% to 22%.

When the chlorination rate is equal to or greater than the above lower limit value, the polarities of the resin and the halogen atom-containing rubber that is contained in the elastic layer are easily brought closer to each other, whereby excellent adhesiveness and adhesion maintainability are exhibited. When the chlorination rate is equal to or less than the above upper limit value, the amount of dechlorination is reduced during vulcanization that is performed when manufacturing the charging roll, and thus the generation of rust on the base member resulting from the dechlorination is effectively suppressed.

In addition, from the viewpoint of improving the adhesiveness and the adhesion maintainability between the elastic layer and the adhesive layer, a resin having the same halogen atoms as those of the halogen atom-containing rubber that is contained in the elastic layer is preferably used.

As the halogen atom-containing resin, halogenated olefins such as halogenated polypropylene polymer, halogenated polyethylene polymer, polychloroprene, chlorinated polybutadiene, chlorinated ethylene-propylene copolymer, chlorinated butadiene-styrene copolymer, and chlorinated polyvinyl chloride, and polyolefin resins that are obtained by graft-modifying the above materials with an unsaturated carboxylic acid such as an acrylic acid, a methacrylic acid, a maleic acid, or an itaconic acid, or an acid anhydride such as maleic anhydride or itaconic acid anhydride are used. These may be used singly or as a mixture of two or more types appropriately.

Examples of the form thereof include a solvent form, a latex form, a hot melt form, and a film form. A solvent form or a hot melt form is preferable from the viewpoint of simplification and facilitation of processing.

Examples of the halogenated polypropylene polymer include chlorinated polypropylene polymer, fluorinated polypropylene polymer, and brominated polypropylene polymer.

Examples of the halogenated polyethylene polymer include chlorinated polyethylene polymer, fluorinated polyethylene polymer, and brominated polyethylene polymer.

Among these, a chlorinated polypropylene polymer modified with maleic anhydride is more preferable from the viewpoint of adhesiveness with the base member having a metal in a surface of the metal shaft or the like.

As the halogen atom-containing resin, only one type may be used or two or more types may be used in combination.

The amount of the halogen atom-containing resin that is contained in the adhesive layer is preferably in a range of 10 parts by weight to 100 parts by weight, and more preferably in a range of 50 parts by weight to 100 parts by weight with respect to 100 parts by weight of the total weight of the adhesive layer from the viewpoint of improving the adhesiveness and the adhesion maintainability between the elastic layer and the adhesive layer.

Other Adhesives

In the adhesive layer 33, adhesives other than the halogen atom-containing resin may foe used in combination. The adhesive to foe used in combination may be formed of a resin or a rubber material, for example. Examples of the resin include polyurethane, acrylic resins such as polymethyl methacrylate and polybutyl methacrylate, polyvinyl butyral, polyvinyl acetal, polyarylate, polycarbonate, polyester, phenoxy resins, polyvinyl acetate, polyamide, polyvinyl pyridine, and cellulose resins. Examples of the rubber material include rubbers such as EPDM, polybutadiene, natural rubber, polyisoprene, styrene-butadiene rubber (SBR), chloroprene rubber (CR), nitrile-butadiene rubber (NBR), silicone rubber, urethane rubber, and epichlorohydrin rubber, and resin materials such as butadiene resins (RB), polystyrene resins such as styrene-butadiene-styrene elastomer (SBS), polyolefin resins, polyester resins, polyurethane, polyethylene (PE), polypropyrene (PP), polyvinyl chloride (PVC), acrylic resins, styrene-vinyl acetate copolymer, butadiene-acrylonitrile copolymer, ethylene-vinyl acetate copolymer, ethylene-ethyl acrylate copolymer, ethylene-methacrylic acid (EMAA) copolymer, and modified products of the above resins.

As the adhesive, when the halogen atom-containing resin and other adhesives are used in combination, the ratio of the halogen atom-containing resin to the whole adhesive is preferably 20% by weight or greater, more preferably 50% by weight or greater, and still mere preferably 100% by weight.

Conducting Agent

The adhesive layer 33 may contain a conducting agent for imparting conductivity to the adhesive layer.

Examples of the conducting agent include conductive powders of carbon black such as Ketjen black and acetylene black; thermal decomposition carbon, graphite; various conductive metals such as aluminum, copper, nickel, and stainless steel or alloys thereof; various conductive metal oxides such as tin oxide, indium, oxide, titanium oxide, tin oxide-antimony oxide solid solution, and tin oxide-indium oxide solid solution; and insulating materials of which the surface is processed to have conductivity.

An average particle diameter of the conducting agent is preferably in a range of 0.01 μm to 5 μm, more preferably in a range of 0.01 μm to 3 μm, and still more preferably in a range of 0.01 μm to 2 μm from the viewpoint of controlling the surface roughness Rz and the friction coefficient of the adhesive layer 33 within the above range.

The average particle diameter is calculated by observing a sample, obtained by cutting the adhesive layer, with an electron microscope, measuring the diameters (the maximum diameters) of 100 conducting agent particles, and averaging the measured diameters.

The amount of the conducting agent to be added to the adhesive layer 33 is preferably in a range of 0.1 part by weight to 6 parts by weight, more preferably in a range of 0.5 part by weight to 6 parts by weight, and still more preferably in a range of 1 part, by weight to 3 parts by weight with respect to 100 parts by weight of the total weight of the adhesive layer from the viewpoint of controlling the surface roughness Rz and the friction coefficient of the adhesive layer 33 within the above range.

Other Components

The adhesive layer may further contain a catalyst, a curing accelerator, an inorganic filler, an organic or polymeric filler, a flame retardant, an antistatic agent, a conductivity imparting agent, a lubricant, a slidability imparting agent, a surfactant, a colorant, or the like, other than the adhesives and conducting agents. Among these, two or more types may be contained.

Surface Roughness Rz and Friction Coefficient (Static Friction Coefficient)

The surface roughness Rz on the outer peripheral surface side of the adhesive layer 33 is in a range of 0.5 μm to 8 μm.

The surface roughness Rz of the adhesive layer is adjusted by selecting a material of the above-described adhesive that is used in the adhesive layer, by selecting the kind of an additive such as a conducting agent, by adjusting a particle diameter or an amount of the additive, or the like.

The friction coefficient on the outer peripheral surface side of the adhesive layer 33 is preferably in a range of 0.4 to 0.7.

The friction coefficient of the adhesive layer is adjusted by selecting a material of the adhesive that is used in the adhesive layer, by controlling a coating condition and a drying condition of the adhesive or a solvent that dilutes the adhesive, or the like.

Formation of Adhesive Layer

The adhesive layer may be formed by coating the base member 30 with a composition such as an adhesive dissolved in a solvent. A heating treatment may be performed after the coating with the adhesive.

Examples of the solvent include normal organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be used singly or in mixture of two or more types.

The thickness of the adhesive layer is not particularly limited, but is preferably in a range of 1 μm to 100 μm, and more preferably in a range of 5 μm to 50 μm.

Conductive Elastic Layer

The conductive elastic layer 31 will be described below.

The conductive elastic layer 31 includes, for example, an elastic material, a conducting agent, and other additives if necessary. The conductive elastic layer 31 is a layer formed on the outer peripheral surface of the base member 30 with an adhesive layer interposed therebetween.

Elastic Material: Halogen Atom-Containing Rubber

In the conductive elastic layer 31, a halogen atom-containing rubber is used as an elastic material from the viewpoint of improving the adhesiveness and the adhesion maintainability between the elastic layer and the adhesive layer.

In this exemplary embodiment, a difference in SP value between the halogen atom-containing resin that is contained in the adhesive layer and the halogen atom-containing rubber that is contained in the elastic layer is preferably 2 or less.

Examples of the halogen atoms include F, Cl, Br, I, and At. Among these, a rubber containing Cl, F, and Br atoms is preferably used, and a rubber containing chlorine atoms is more preferably used.

In addition, from the viewpoint of improving ton adhesiveness and the adhesion maintainability between the elastic layer and the adhesive layer, a rubber having the same halogen atoms as those of the halogen atom-containing resin that is contained in the adhesive layer is preferably used.

Examples of the halogen atom-containing rubber include epichlorohydrin rubber, epichlorohydrin-ethylene oxide copolymer rubber, and epichlorohydrin-ethylene oxide-allyl glycidyl ether copolymer rubber.

Among these, epichlorohydrin-ethylene oxide-allyl glycidyl ether copolymer rubber is more preferable.

The halogen atom-containing rubbers may be used singly or in combination of two or more types.

Other Elastic Materials

In the conductive elastic layer, elastic materials other than the halogen atom-containing rubber may be used in combination. Examples of elastic materials that may be used in combination include isoprene rubber, chloroprene rubber, epichlorohydrin robber, butyl rubber, polyurethane, silicone rubber, fluororubber, styrene-butadiene rubber, butadiene rubber, nitrile rubber, ethylene propylene rubber, ethylene-propylene-diene terpolymer copolymer rubber (EPDM), acrylonitrile-butadiene copolymer rubber (NBR), natural rubber, and blends thereof. The rubbers may be foamed or unfoamed.

As the elastic material, when the halogen atom-containing rubber and other elastic materials are used in combination, the ratio of the halogen atom-containing rubber to the whole elastic material is preferably 50% by weight or greater, more preferably 70% by weight or greater, and still more preferably 100% by weight.

Conducting Agent

Examples of the conducting agent include an electron conducting agent and an ion conducting agent. Examples of the electron conducting agent include powders of carbon black such as Ketjen black and acetylene black; thermal decomposition carbon, graphite; various conductive metals such as aluminum, copper, nickel, and stainless steel or alloys thereof; various conductive metal oxides such as tin oxide, indium oxide, titanium oxide, tin oxide-antimony oxide solid solution, and tin oxide-indium oxide solid solution; and insulating materials of which the surface is processed to have conductivity. Examples of the ion conducting agent include perchlorates and chlorates of tetraethyl ammonium and lauryl trimethyl ammonium; alkali metals such as lithium and magnesium, and perchlorates and chlorates of alkaline earth metals.

The conducting agents may be used singly or in combination, of two or more types.

Here, specific examples of the carbon black include "SPECIAL SLACK 350", "SPECIAL BLACK 100", "SPECIAL SLACK 250", "SPECIAL BLACK 2", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V", all of which are manufactured by Evonik Degussa Corporation, and "MONARCH 1000", "MONARCH 1300", "MONARCH 1400", "MOGUL-L", and "REGAL 400R", all of which are manufactured by Cabot Corporation.

The average particle diameter of the conducting agents is preferably in a range of 1 nm to 200 nm.

The average particle diameter is calculated by observing a sample, obtained by cutting the conductive elastic layer 31, with an electron microscope, measuring the diameters (the maximum diameters) of 100 conducting agent particles, and averaging the measured diameters.

The amount of the conducting agent to be added is not particularly limited. However, in the case of the electron conducting agent, the amount of the conducting agent is preferably in a range of 1 part by weight to 30 parts by weight, and more preferably in a range of 15 parts by weight to 25 parts by weight with respect to 100 parts by weight of the elastic material. In the case of the ion conducting agent, the amount of the conducting agent is preferably in a range of 0.1 part by weight to 5.0 parts by weight, and more preferably in a range of 0.5 part by weight to 3.0 parts by weight with respect to 100 parts by weight of the elastic material.

Other Additives

Examples of other additives mixed into the conductive elastic layer 31 include materials that may be typically added to an elastic layer, such as a softener, a plasticizer, a curing agent, a vulcanizing agent, a vulcanization accelerator, an antioxidant, a surfactant, a coupling agent, and a filler (such as silica and calcium carbonate).

Formation of Conductive Elastic Layer

The forming method is not particularly limited, and for example, the conductive elastic layer 31 is formed on the outer peripheral surface of the adhesive layer by extruding the material of the conductive elastic layer along with the base member 30 having the adhesive layer 33 formed thereon by the use of an extrusion molding machine including a cross head and the like.

The method of forming the conductive elastic layer using the extrusion molding machine including the cross head will be described below with reference to the accompanying drawing.

Figure 3:
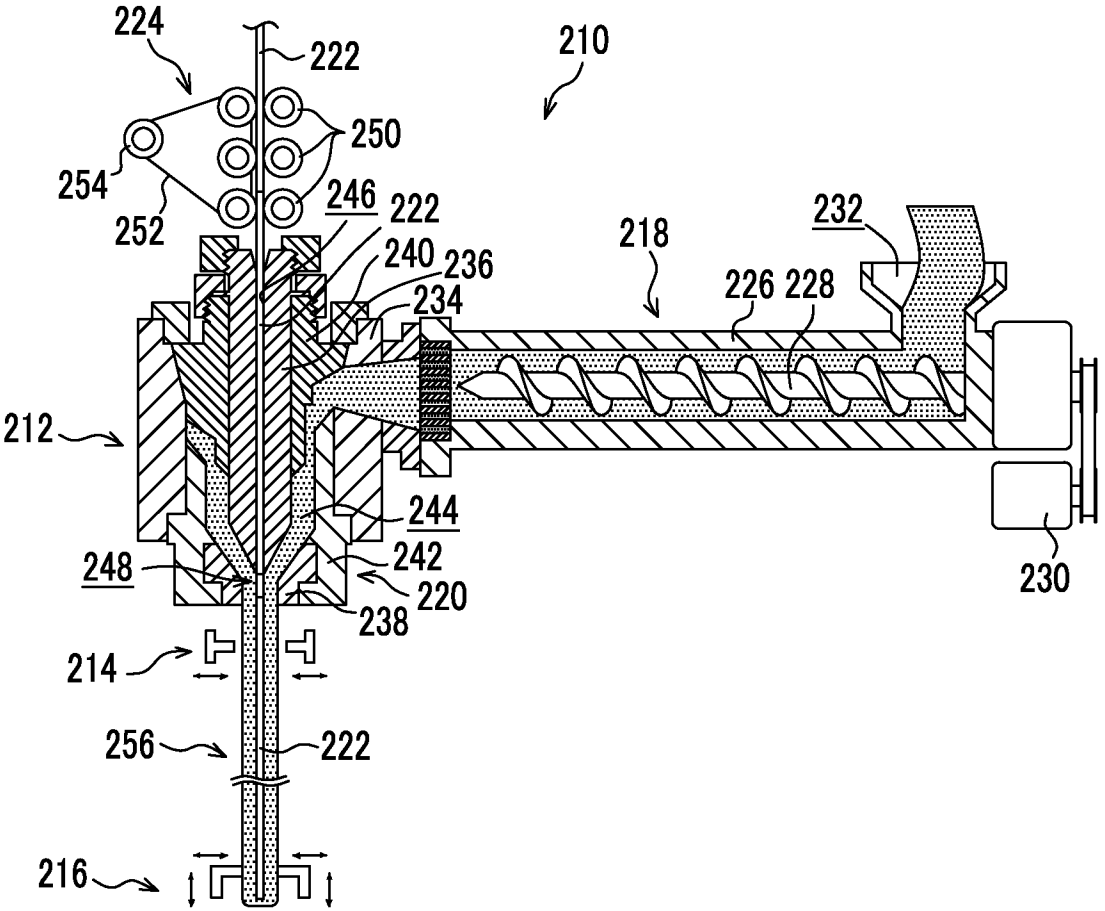
FIG. 3 is a diagram schematically illustrating an extrusion molding machine having a cross head.

FIG. 3 shows the configuration of a rubber roll manufacturing apparatus (the extrusion molding machine including the cross head) 210 used to form an elastic layer in this exemplary embodiment.

The rubber roll manufacturing apparatus 210 according to this exemplary embodiment includes a discharger 212 including a so-called cross head die, a pressurizer 214 disposed below the discharger 212, and a puller 216 disposed below the pressurizer 214.

The discharger 212 includes a rubber material feeding unit 218 feeding an unvulcanized rubber material (the material for forming the conductive elastic layer 31), an extrusion unit 220 extruding the rubber material fed from the rubber material feeding unit 218 in a cylindrical shape, and a core feeding unit 224 feeding a core 222 (the base member 30 having the adhesive layer formed thereon) to the central part of the rubber material extruded in a cylindrical shape from the extrusion unit 220.

The rubber material feeding unit 218 includes a screw 223 in a tabular body 226. The screw 228 is rotationally driven by a drive motor 230. An input port 232 to which the rubber material is input is disposed on the side of the drive motor 230 of the body 226. The rubber material input from, the input, port 232 is forwarded to the extrusion unit 220 while being kneaded by the screw 228 in the body 226. By adjusting the rotation speed of the screw 228, the speed at which the rubber material is forwarded may be adjusted.

The extrusion unit 220 includes a tubular case 234 connected to the rubber material feeding unit 218, a columnar mandrel 236 disposed at the center in the case 234, and a discharge head 238 disposed below the mandrel 236. The mandrel 236 is held in the case 234 by a holding member 240. The discharge head 238 is held in the case 234 by a holding member 242. An annular flow channel 244 in which the rubber material flows in a ring shape is formed between the outer peripheral surface (the outer peripheral surface of the holding member 240 in a part) of the mandrel 236 and the inner peripheral surface (the inner peripheral surface of the discharge head 238 in a part) of the holding member 242.

An insertion hole 246 through which the core 222 passes is formed at the center of the mandrel 236. The lower part of the mandrel 236 is tapered to the end thereof. The region below the tip of the mandrel 236 is a join region 243 in which the core 222 fed from the insertion hole 246 and the rubber material fed from the annular flow channel 244 join. That is, the rubber material is extruded in a cylindrical shape toward the join region 248 and the core 222 is fed to the central part of the rubber material extruded in a cylindrical shape.

The core feeding unit 224 includes roller pairs 250 disposed above the mandrel 236. Plural (three) roller pairs 250 are provided. One roller of each roller pair 250 is connected to a driving roller 254 with a belt 252. When the driving roller 254 is driven, the core 222 pinched by the roller pairs 250 is forwarded to the insertion hole 246 of the mandrel 236. The core 222 has a predetermined length, and plural cores 222 sequentially pass through the insertion hole 246 by causing a following core 222 forwarded by the roller pairs 250 to extrude a preceding core 222 present in the insertion hole 246 of the mandrel 236. The driving of the driving roller 254 is temporarily stopped when the front end of the preceding core 222 is located at the tip of the mandrel 236, and the cores 222 are forwarded with a gap in the join region 248 below the mandrel 236.

In this way, in the discharger 212, the rubber material is extruded in a cylindrical shape in the join region 248 and the cores 222 are sequentially forwarded with a gap to the central part of the rubber material. Accordingly, the outer peripheral surface of the core 222 is coated with the rubber material, and a rubber roll portion 256 (that is, the conductive elastic layer) is formed on the outer peripheral surface of the core 222 (the base member 30 having the adhesive layer formed thereon).

The thickness of the conductive elastic layer 31 is preferably in the range of 1 mm to 10 mm and more preferably in the range of 2 mm to 5 mm.

The volume resistivity of the conductive elastic layer 31 is preferably in a range of $10^3$ Ωcm to $10^{14}$ Ωcm.

Conductive Outermost Layer

A polymeric material constituting the conductive outermost layer 32 is not particularly limited. Examples thereof include polyamide, polyurethane, polyvinylidene fluoride, tetrafluoroethylene copolymer, polyester, polyimide, silicone resin, acrylic resin, polyvinyl buryral, ethylene tetrafluoroethylene copolymer, melamine resin, fluororubber, epoxy resin, polycarbonate, polyvinyl alcohol, cellulose, polyvinylidene chloride, polyvinyl chloride, polyethylene, and ethylene-vinyl acetate copolymer.

The polymeric materials may be used singly or in mixture or co-polymerization of two or more types. The number-average molecular weight of the polymeric materials is preferably in a range of 1,000 to 100,000 and more preferably in a range of 10,000 to 50,000.

The conductive outermost layer 32 may be formed of a composition obtained by mixing the conducting agents used in the conductive elastic layer 31 or various particles described below as a conducting agent with the polymeric materials. The amount thereof to be added is not particularly limited, but is preferably in a range of 1 part by weight to 50 parts by weight, and more preferably in a range of 5 parts by weight to 20 parts by weight, with respect to 100 parts by weight of the polymeric material.

As the particles, metal oxides and complex metal oxides such as silicon oxide, aluminum oxide, and barium titanate and polymer powders such as tetrafluoroethylene and vinylidene fluoride may be used singly or in combination, but the particles are not particularly limited to these examples.

The thickness of the conductive outermost layer 32 is preferably thick in consideration of durability against abrasion of the charging member, but the thickness is preferably in a range of 0.01 μm to 1000 μm, more preferably in a range of 0.1 μm to 500 μm, and still more preferably in a range of 0.5 μm to 100 μm.

The conductive outermost layer 32 may be formed on the conductive elastic layer using a dipping method, a spray method, a vacuum deposition method, a plasma, coating method, or the like. Among these methods, the dipping method may be preferably used from the viewpoint of manufacturing processes.

A method of manufacturing a charging roll according to this exemplary embodiment includes forming a conductive adhesive layer that includes a halogen atom-containing resin and has surface roughness Rz in a range of 0.5 μm to 3 μm on an outer peripheral surface side on a cylindrical base member that has a metal-containing surface, and forming a conductive elastic layer that includes a halogen atom-containing rubber through extrusion molding so as to bring the conductive elastic layer into contact with the outer peripheral surface of the conductive adhesive layer.

Charging Unit

A charging unit according to this exemplary embodiment will be described below.

Figure 4:
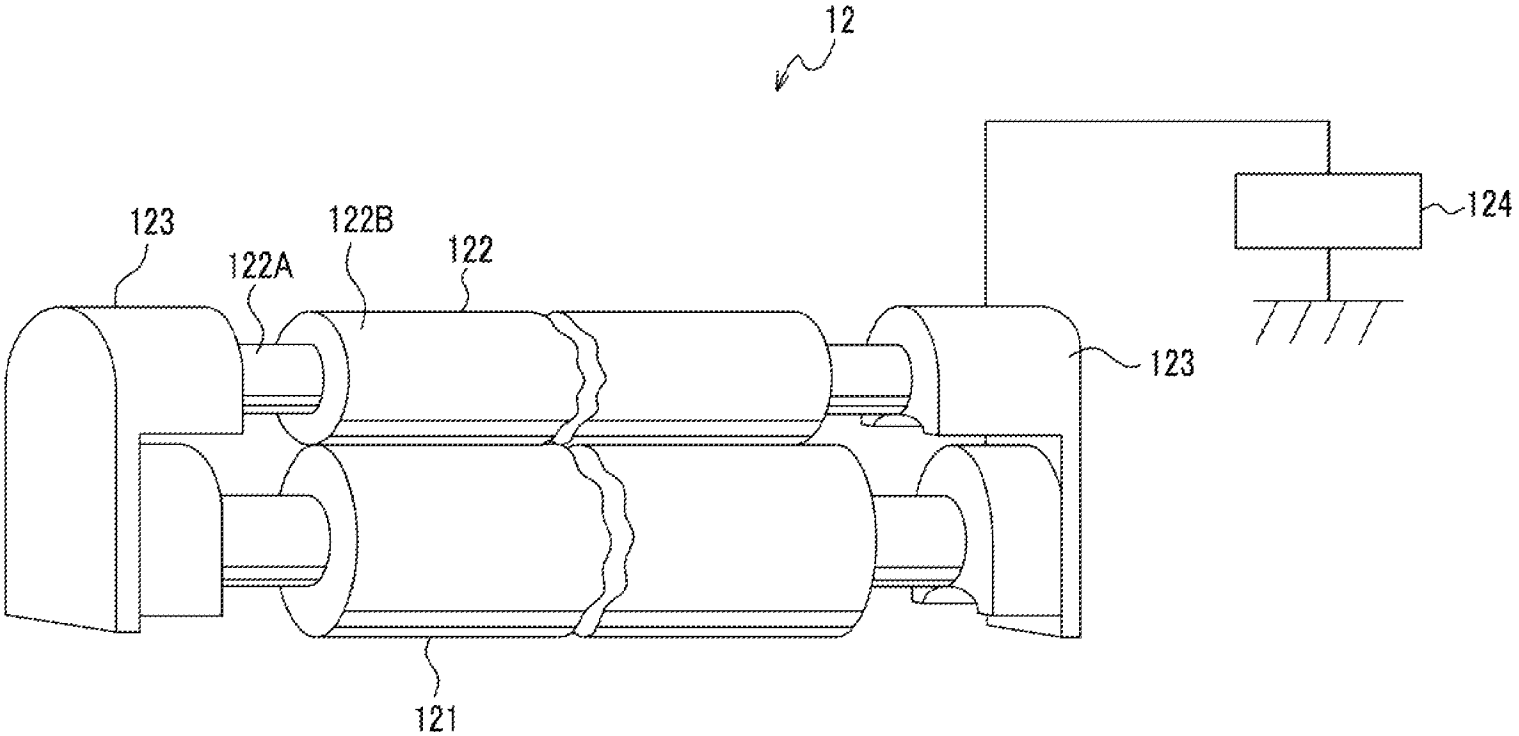
FIG. 4 is a perspective view schematically illustrating a charging unit according to an exemplary embodiment of the invention.

FIG. 4 is a perspective view schematically illustrating a charging unit according to this exemplary embodiment.

In the charging unit according to this exemplary embodiment, the charging roll according to this exemplary embodiment is used as a charging roll.

Specifically, in the charging unit 12 according to this exemplary embodiment, for example, a charging roll 121 and a cleaning member 122 are in contact with each other with a specific amount of inroad, as shown in FIG. 4. Both ends in the axis direction of a base member 30 of the charging roll 121 and a base member 122A of the cleaning member 122 are held by conductive bearings 123 (conductive bearing) so that the members are rotatable. A power source 124 is connected to one of the conductive bearings 123.

The charging unit according to this exemplary embodiment is not limited to the above-described configuration, and, for example, the cleaning member 122 may be removed.

The cleaning member 122 is a cleaning member cleaning the surface of the charging roll 121 and is formed, for example, in a roll shape. The cleaning member 122 includes, for example, the base member 122A having a tubular or columnar shape and an elastic layer 122B on the outer peripheral surface of the base member 122A.

The base member 122A is a rod-like conductive member. Examples the material of the base member include metals such as iron (such as free-cutting steel), copper, brass, stainless steel, aluminum, and nickel. Members (such as resin or ceramic members) having the outer peripheral surface plated or members (such as resin or ceramic members) in which a conducting agent is dispersed may also be used as the base member 122A. The base member 122A may be a hollow member (tubular member) or a non-hollow member.

The elastic layer 122B is formed of a foam having a three-dimensional porous structure, has voids or unevenness (hereinafter, referred to as cells) in or on the surface thereof, and preferably has elasticity. The elastic layer 122B includes foamed resin materials or rubber materials such as polyurethane, polyethylene, polyamide, olefin, melamine or polypropylene, acrylonitrile-butadiene copolymer rubber (NBR), ethylene-propylene-diene copolymer rubber (EPDM), natural rubber, styrene-butadiene rubber, chloroprene, silicone, and nitrile.

Among the foamed resin materials and rubber materials, polyurethane resistant to tearing and tensile strength may be particularly suitably used so as to efficiently clean particles of the toner or the external additives by the driven frictional slide over the charging roll 121, to make it difficult for the surface of the charging roll 121 to be damaged due to the friction with the cleaning member 122, and to make it difficult to disconnect or break the elastic layer for a long time.

The polyurethane is not particularly limited, and examples thereof include reactants of as polyols (such as polyester polyol, polyether polyester, and acrylpolyol) and isocyanates (such as 2,4-tolylene diisocyanate, 2,6-tolylene diisocyanate, 4,4-diphenylmethane diisocyanate, tolidine diisocyanate, and 1,6-hexamethylene diisocyanate) and reactants based on chain extenders (such as 1,4-butanediol and trimethylolpropane). The polyurethane is typically foamed using a foaming agent (such as water or azo compounds (such as azodicarbonamide and azobisisobutyronitrile).

The number of cells in the elastic layer 122B is preferably in the range of 20/25 mm to 80/25 mm, more preferably in the range of 30/25 mm to 80/25 mm, and yet more preferably in the range of 30/25 mm to 50/25 mm.

The hardness of the elastic layer 122B is preferably in the range of 100 N to 500 N, more preferably in the range of 100 N to 400 N, and yet more preferably in the range of 150 N to 400 N.

The conductive bearings 123 are members holding the charging roll 121 and the cleaning member 122 so as to be rotatable together and maintaining the inter-shaft distance therebetween. The conductive bearings 123 may have any material and shape, as long as they are formed of a conductive material. Examples thereof include a conductive bearing or a conductive sliding bearing.

The power source 124 is a device that applies a voltage to the conductive bearings 123 to charge the charging roll 121 and the cleaning member 122 to the same polarity and a known high-voltage power source is used.

In the charging unit 12 according to this exemplary embodiment, the charging roll 121 and the cleaning member 122 are charged to the same polarity, for example, by applying a voltage to the conductive beatings 123 from the power source 124.

Image Forming Apparatus and Process Cartridge

An image forming apparatus according to this exemplary embodiment includes an image holding member, a charging unit that charges the image holding member, a latent image forming unit that forms a latent image on the charged surface of the image holding member, a developing unit that develops the latent image formed on the surface of the image holding member with a toner to form a toner image, and a transfer unit that transfers the toner image formed on the surface of the image holding member to a recording medium. The above-described charging unit according to this exemplary embodiment is used as the charging unit (charging device).

More specifically, an image forming apparatus according to this exemplary embodiment includes an image holding member, a charging unit that charges the image holding member and includes the charging roll according to this exemplary embodiment, a pressing member that presses the charging roll against the image holding member in a normal direction of a surface where the image holding member and the charging roll are brought into contact with each other, a latent image forming unit that forms a latent image on the charged surface of the image holding member, a developing unit that develops the latent image formed on the surface of the image holding member with a toner to form a toner image, and a transfer unit that transfers the toner image formed on the surface of the image holding member to a recording medium.

On the other hand, a process cartridge according to this exemplary embodiment is detachable from, for example, the image forming apparatus having the above-described configuration and includes an image holding member and a charging unit that charges the image holding member. The above-described charging unit according to this exemplary embodiment is used as the charging unit. The process cartridge according to this exemplary embodiment may include at least one selected from the group consisting of a developing unit that develops a latent image formed on the surface of the imago holding member with a toner to form a toner image, a transfer unit that transfers the toner image formed on the surface of the image holding member to a recording medium, and a cleaning unit that removes the toner remaining on the surface of the image holding member after the transfer, if necessary.

Figure 5:
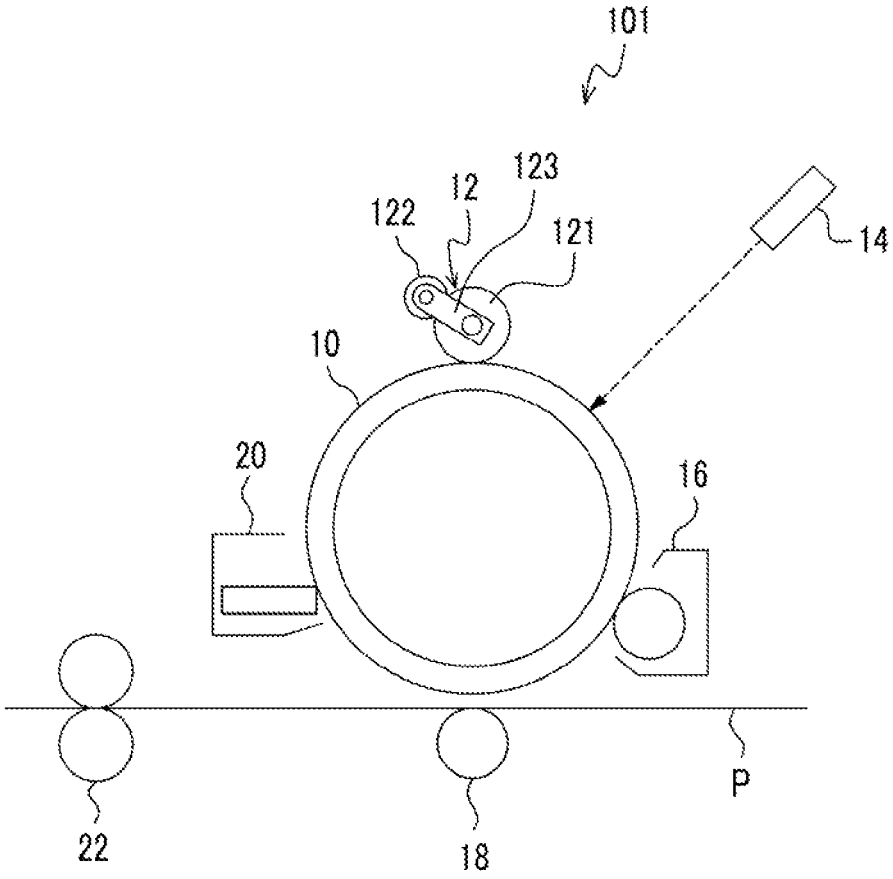
FIG. 5 is a diagram schematically illustrating the configuration of an image forming apparatus according to an exemplary embodiment of the invention.
Figure 6:
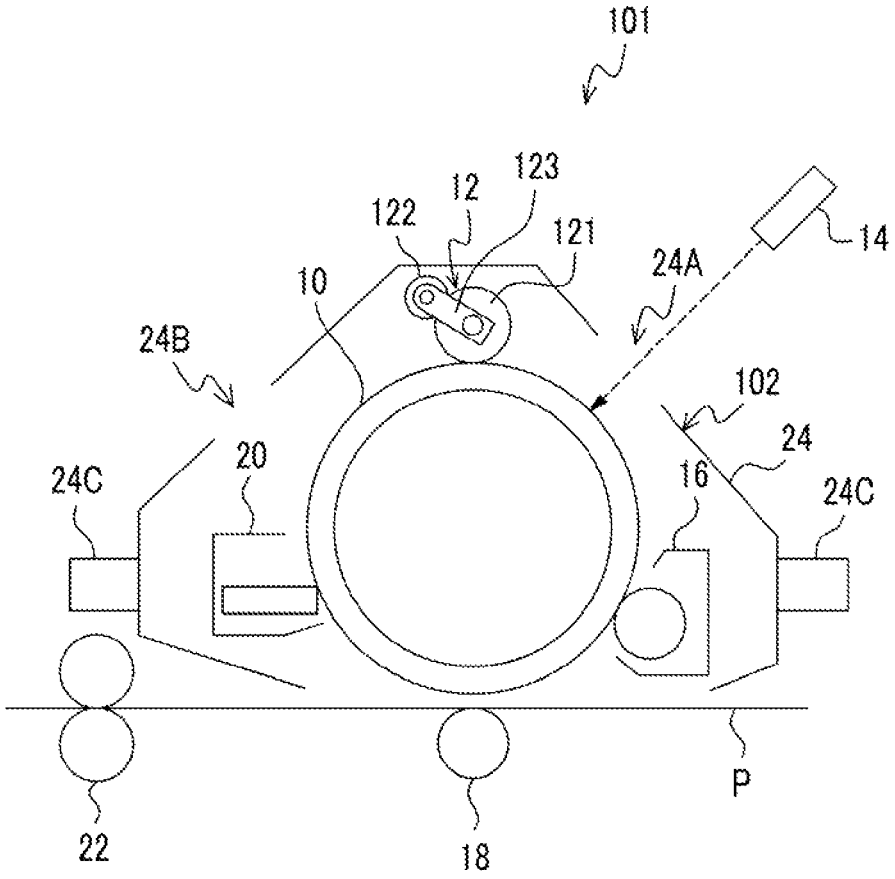
FIG. 6 is a diagram schematically illustrating the configuration of a process cartridge according to an exemplary embodiment of the invention.

The image forming apparatus and the process cartridge according to this exemplary embodiment will be described below with reference to the accompanying drawings. FIG. 5 is a diagram schematically illustrating the configuration of the image forming apparatus according to this exemplary embodiment. FIG. 6 is a diagram schematically illustrating the configuration of the process cartridge according to this exemplary embodiment.

As shown in FIG. 5, an image forming apparatus 101 according to this exemplary embodiment includes an image holding member 10 and further includes a charging unit 12 charging the image holding member 10, an exposing unit 14 exposing the image holding member 10 charged by the charging unit 12 to form a latent image, a developing unit 16 developing the latent image formed, by the exposing unit 14 with a toner to form a toner image, a transfer unit 18 transferring the toner image formed by the developing unit 16 to a recording medium P, and a cleaning unit 20 removing the toner remaining on the surface of the image holding member 10 after the transfer, around the image holding member 10. The image forming apparatus 101 further includes a fixing unit 22 fixing the toner image transferred to the recording medium P by the transfer unit 18.

The image forming apparatus 101 according to this exemplary embodiment employs as the charging unit 12 the charging unit according to this exemplary embodiment provided with the charging roll 121, the cleaning member 122 disposed in contact with the charging roll 121, the conductive bearings 123 (conductive bearings) holding both ends in the axis direction of the charging roll 121 and the cleaning member 122 so as to be independently rotatable, and the power source 124 connected to one of the conductive bearings 123.

On the other hand, the image forming apparatus 101 according to this exemplary embodiment employs the known constituents of an electrophotographic image forming apparatus according to the related art as the constituents other than the charging unit 12 (the charging roll 121). An example of each constituent will be described below.

The image holding member 10 employs a known photoreceptor without any particular limitation, and a so-called function-divided organic photoreceptor in which a charge generating layer and a charge transporting layer are divided may be suitably used. The surface layer of the image holding member 10 may preferably be coated with a protective layer having a charge transporting function and a cross-linking structure. Examples of the cross-linking component of the protective layer preferably include photoreceptors formed of a siloxane-based resin, a phenol-based resin, a melamine resin, a guanamine resin, and an acrylic resin.

For example, a laser optical system or an LED array is used as the exposing unit 14.

The developing unit 16 is a developing unit that allows a developer holding member having a developer layer formed on the surface thereof to come in contact with or to get close to the image holding member 10 and attaching the toner to the latent image on the surface of the Image holding member 10 to form a toner image. The developing method of the developing unit 16 preferably employs a known developing method using a two-component developer. Examples of the developing method using the two-component developer include a cascade method and a magnetic brush method.

The transfer unit 18 may employ any of a non-contact-type transfer method, for example, using a corotron and a contact-type transfer method of bringing a conductive transfer roll into contact with the image holding member 10 with a recording medium P interposed therebetween and transferring the toner image to the recording medium P.

The cleaning unit 20 is a member bringing, for example, a cleaning blade into direct contact with surface of the image holding member 10 to remove the toner, paper powder, and dust attached to the surface. In the cleaning unit 20, a cleaning brush, a cleaning roll, or the like may be used instead of the cleaning blade.

As the fixing unit 22, a thermal fixing unit using a heating roll is suitably used. The thermal fixing unit includes, for example, a fixing roller in which a heater lamp for heating is provided in a cylindrical core and a heat-resistant coating film layer or a heat-resistant rubber coating film layer forms a so-called release layer on an outer peripheral surface of the cylindrical core, and a pressure roller or a pressure belt that is disposed to be brought into contact into the fixing roller at a specific contact pressure and has a heat-resistant elastic body layer formed on an outer peripheral surface of a cylindrical core or a surface of a belt-like base member. A process of fixing an unfixed toner image includes, for example, inserting a recording medium P to which an unfixed toner image is transferred between the fixing roller and the pressure roller or the pressure belt to conduct fixing by thermofusion of the binder resin, additives and the like in the toner.

The image forming apparatus 101 according to this exemplary embodiment is not limited to the above-described configuration and may be an intermediate transfer type image forming apparatus employing an intermediate transfer medium or a so-called tandem type image forming apparatus in which image forming units forming toner images of different colors are arranged in parallel.

On the other hand, as shown in FIG. 6, the process cartridge according to this exemplary embodiment is a process cartridge 102 in which the image holding member 10, the charging unit 12 charging the image holding member, the developing unit 16 developing the latent image formed by the exposing unit 14 with a toner to form a toner image, and the cleaning unit 20 removing the toner remaining on the surface of the image holding member 10 after the transfer are integrally combined, held, and configured by the use of a housing 24 including an exposure opening 24A, a charge-removing exposure opening 24B, and an attachment rail 24C in the image forming apparatus shown in FIG. 5. The process cartridge 102 is detachably attached to the image forming apparatus 101 shown in FIG. 5.

EXAMPLES

The invention will be described in more detail below with reference to examples, but the invention is not limited to the following examples. So long as not mentioned, differently, "part" means "part by weight".

Example 1

Manufacturing of Charging Roll

Preparation of Base Member

A base member formed of SUM 23L (free-cutting steel) is electroless nickel plated into a thickness of 5 μm, and then a 6-valent chromic acid is applied thereto to obtain a conductive base member with a diameter of 8 mm.

Formation of Adhesive Layer

Next, the following mixture for an adhesive layer is mixed for 1 hour using a ball mill, and then brush coating is performed to form a conductive adhesive layer having a thickness of 20 μm on a surface of the base member.

Preparation of Mixture for Adhesive Layer

A mixture is obtained by mixing the following compositions. The viscosity thereof is adjusted using toluene or xylene.

Chlorinated Polypropylene Resin (Chlorinated Maleic Anhydride Polypropylene Resin: Super Clone 930, manufactured by Nippon Paper Industries Co., Ltd. Chemical Division): 100 parts Conducting Agent (Carbon Black: Ketjen Black EC, manufactured by Ketjen Black International Co, Ltd.): 2.5 parts Formation of Elastic Layer A mixture for an elastic layer having the following composition is kneaded using an open roll to form an elastic layer on a surface of the adhesive layer using an extrusion molding machine, and vulcanization is performed thereon. At this time, an overall size of a base member (shaft) transport path is 8 mmϕ. A base member having an outer diameter of 7.98 mmϕ and a length of 350 mm is used, and as a cross head extrusion device, a 40 mm extruder manufactured by Mitsuba Mfg. Co., Ltd. and a cross head die having a die nozzle inner diameter of 13 mmϕ are used.

Clogging does net occur in the base member during extrusion molding.

A friction coefficient of the adhesive layer that is measured at this time is 0.67.

In addition, a friction coefficient of the adhesive layer that is measured after an elastic layer is formed as described above, a surface layer to be described later are formed, and then the elastic layer and the surface layer are peeled from the adhesive layer is the same as above value, that is, 0.67.

Composition of Mixture for Elastic Layer

Rubber Material Epichlorohydrin-Ethyleneoxide-Allylglycidylether Copolymer Rubber: Gechron 3106, manufactured by Zeon Corporation): 100 parts Conducting Agent (Carbon Black: ASAHI Thermal, manufactured by Asahi Carbon Co., Ltd.): 15 parts Conducting Agent (Ketjen Slack EC: manufactured by Lion Corporation): 5 parts Ion Conducting Agent (Lithium Perchlorate): 1 part Vulcanizing Agent (Sulfur 200 Mesh, manufactured by Tsurumi Chemical Industry Co., Ltd.): 1 part Vulcanization Accelerator (Nocceler DM, manufactured by Ouchi Shinko Chemical Industrial Co., Ltd.): 2.0 parts Vulcanization Accelerator (Nocceler TT, manufactured by Ouchi Shinko Chemical Industrial Co., Ltd.): 0.5 part Vulcanization Accelerating aid (Zinc Oxide, First Class Zinc Oxide, manufactured by Seido Chemical Industry Co., Ltd.): 3.0 parts Stearic Acid: 1.5 parts Formation of Surface Layer A dispersion A that is obtained by dispersing a mixture, obtained by mixing the following compositions, using a bead mill is diluted with methanol, and the resultant material is applied to a surface of the elastic layer by dipping. Then, the resultant material is heated and dried at 145° C. for 30 minutes to form a surface layer having a thickness of 10 μm, whereby a conductive elastic roll 1 is obtained.

N-Methoxymethylated Nylon 1 (F30K, manufactured by Nagase ChemteX Corporation): 90 parts Polyvinyl Acetal Resin (S-LEC BL-1, manufactured by Sekisui Chemical Co., Ltd.): 10 parts Conducting Agent (Carbon Slack MONARCH 1000, manufactured by Cabot Corporation): 17 parts Catalyst (Manure 4167, manufactured by King Industries, Inc.): 4.4 parts

Example 2

Manufacturing of Charging Roll

Preparation of Base Member

A conductive bass member is prepared using the method described in Example 1.

Formation of Adhesive Layer

A conductive adhesive layer is formed using the method described in Example 1, except that the composition of the mixture for an adhesive layer in Example 1 is changed as follows.

Preparation of Mixture for Adhesive Layer

Chlorinated Polypropylene Resin (Chlorinated Maleic Anhydride Polypropylene Resin: Super Clone 803MW, manufactured by Nippon Paper Industries Co., Ltd. Chemical Division): 100 parts Conducting Agent (Carbon Black: Ketjen Black EC, manufactured by Ketjen Black International Co.): 2.5 parts The viscosity is adjusted using toluene or xylene.

Formation of Elastic Layer

An elastic layer is formed using the method described in Example 1.

Clogging does not occur in the base member during extrusion molding. At this time, a friction coefficient of the adhesive layer is 0.69.

Example 3

Manufacturing of Charging Roll

Preparation of Base Member

A conductive base member is prepared using the method described in Example 1.

Formation of Adhesive Layer

A conductive adhesive layer is formed using the method described in Example 1, except that the composition of the mixture for an adhesive layer in Example 1 is changed as follows.

Preparation of Mixture for Adhesive Layer

Chlorinated Polypropylene Resin (Chlorinated Maleic Anhydride Polypropylene Resin: Super Clone 930, manufactured by Nippon Paper Industries Co., Ltd. Chemical Division): 100 parts Conducting Agent (Carbon Black: Ketjen Black EC, manufactured by Ketjen Black International Co.): 4 parts The viscosity is adjusted using toluene or xylene.

Formation of Elastic Layer

An elastic layer is formed using the method described in Example 1.

Clogging does not occur in the base member during extrusion molding. At this time, a friction coefficient of the adhesive layer is 0.3.

Example 4

Manufacturing of Charging Roll

Preparation of Base Member

A conductive base member is prepared using the method described in Example 1.

Formation of Adhesive Layer

A conductive adhesive layer is formed using the method described in Example 1, except that the composition of the mixture fox an adhesive layer in Example 1 is changed as follows.

Preparation of Mixture for Adhesive Layer

Chlorinated Polypropylene Resin (Chlorinated Maleic Anhydride Polypropylene Resin: Super Clone 930, manufactured by Nippon Paper Industries Co., Ltd. Chemical Division): 100 parts Conducting Agent (Carbon Black: Ketjen Black EC, manufactured by Ketjen Black International Co.): 5.5 parts The viscosity is adjusted using toluene or xylene.

Formation of Elastic Layer

An elastic layer is formed using the method described in Example 1.

Clogging does not occur in the base member during extrusion molding. At this time, a friction coefficient of the adhesive layer is 0.3.

Example 5

Manufacturing of Charging Roll

Preparation of Base Member

A conductive base member is prepared using the method described in Example 1.

Formation of Adhesive Layer

A conductive adhesive layer is formed, using the method described in Example 1, except that the composition of the mixture for an adhesive layer in Example 1 is changed as follows.

Preparation of Mixture for Adhesive Layer

Chlorinated Polypropylene Resin (Chlorinated Maleic Anhydride Polypropylene Resin: Super Clone 930, manufactured by Nippon Paper industries Co., Ltd. Chemical Division): 100 parts Conducting Agent (Carbon Black: Ketjen Black EC, manufactured by Ketjen Black International Co.): 0.1 part The viscosity is adjusted using toluene or xylene.

Formation of Elastic Layer

An elastic layer is formed using the method described in Example 1.

Clogging does not occur in the base member during extrusion molding. At this time, a friction coefficient of the adhesive layer is 0.80.

Example 6

Manufacturing of Charging Roll

Preparation of Base Member

A conductive base member is prepared using the method described in Example 1.

Formation of Adhesive Layer

A conductive adhesive layer is formed using the method described in Example 1, except that the composition of the mixture for an adhesive layer in Example 1 is changed as follows.

Preparation of Mixture for Adhesive Layer

Chlorinated Polypropylene Resin (Chlorinated Maleic Anhydride Polypropylene Resin: Super Clone 930, manufactured by Nippon Paper Industries Co., Ltd. Chemical Division): 100 parts Conducting Agent (Carbon Black: Ketjen Black EC, manufactured by Ketjen Black International Co.): 1 part The viscosity is adjusted using toluene or xylene.

Formation of Elastic Layer

An elastic layer is formed using the method described in Example 1.

Clogging does not occur in the base member during extrusion molding. At this time, a friction coefficient of the adhesive layer is 0.88.

Comparative Example 1

Manufacturing of Charging Roll

Preparation of Base Member

A conductive base member is prepared using the method described in Example 1.

Formation of Adhesive Layer

A conductive adhesive layer is formed using the method described in Example 1, except that the composition of the mixture for an adhesive layer in Example 1 is changed as follows.

Preparation of Mixture for Adhesive Layer

Polyolefin Resin Composition (product name: XJ150, manufactured by LORD Corporation): 100 parts Conducting Agent (Carbon Black: Ketjen Black EC, manufactured by Ketjen Black International Co.): 2.5 parts The viscosity is adjusted using toluene or xylene.

Comparative Example 2

A conductive adhesive layer is formed using the method described in Example 1, except that the composition of the mixture for an adhesive layer in Example 1 is changed as follows.

Chlorinated Polypropylene Resin (Chlorinated Maleic Anhydride Polypropylene Resin: Super Clone 930, manufactured by Nippon Paper Industries Co., Ltd. Chemical Division): 100 parts Conducting Agent (Carbon Black: Ketjen Black EC, manufactured by Ketjen Black International Co.): 0 part The viscosity is adjusted using toluene or xylene.

Comparative Example 3

A conductive adhesive layer is formed using the method described in Example 1, except that the composition of the mixture for an adhesive layer in Example 1 is changed as follows.

Chlorinated Polypropylene Resin (Chlorinated Maleic Anhydride Polypropylene Resin: Super Clone 930, manufactured by Nippon Paper Industries Co., Ltd. Chemical Division): 100 parts Conducting Agent (Carbon Black: Ketjen Black EC, manufactured by Ketjen Black International Co.): 6.0 parts The viscosity is adjusted using toluene or xylene.

Formation of Elastic Layer

An elastic layer is formed using the method described in Example 1.

Clogging does not occur in the base member during extrusion molding. At this time, a friction coefficient of the adhesive layer is 0.37.

Evaluation

Surface State of Base Member

After the charging roll is kept under a high-temperature and high-humidity environment (45° C., 95% RH) for 10 days, the surface state thereof is observed and the elastic layer including the surface layer is peeled-off to observe the surface of the base member. The results are shown in Table 1.

A: There is no difference from the surface state before forming the elastic layer.

B: Pin holes are observed in at Least one of the adhesive layer and the conductive support.

C: The conductive support is corroded and swelled and peeling-off is observed in at least one of the adhesive layer and the conductive support.

Adhesiveness

In order to check the adhesive strength of the adhesive layer, a cut is formed in the elastic layer of the charging roll using a cutter and peeling-off of the elastic layer is tried with hands.

A: The peeling-off does not easily occur due to the strong adhesion or the breaking of the elastic layer is observed.

B: Although resistance is present at the interface between the conductive support and the adhesive layer or at the interface between the adhesive layer and the elastic layer, they are peeled off.

C: The peeling-off easily occurs at the interface between the conductive support and the adhesive layer or the interface between the adhesive layer and the elastic layer.

Image Quality (Moldability by Extrusion Molding)

The charging roll is mounted as a charging roll on a drum cartridge of a color copier DocuCentre C4475: manufactured by Fuji Xerox Co., Ltd. and a 50% halftone image is printed using DocuCentre C4475 under the environment of 10° C. and 15% RH and under the environment of 28° C. and 85% RH. The obtained halftone images are evaluated in terms of the following criteria.

A: Density unevenness, white points, and color points are not caused.

B: Slight density unevenness, white points, and color points are partially caused.

C: Density unevenness, white points, and color points are caused.

Charging Maintainability

The charging roll is mounted on a drum cartridge of DocuCentre Color 400CP (manufactured by Fuji Xerox Co., Ltd.), and a print test is carried out with 50,000 sheets of A4 (50,000 sheets under the environment of 10° C. and 15% RH). Then, with image defects that are caused when a 50% halftone image is printed using DocuCentre Color 400CP, determination is performed based on the following criteria.

A: There is no image disarray.

B: Image disarray partially occurs.

C: Image disarray occurs as a whole.

TABLE 1

| | Examples | | | | | | Comparative Examples | | |
|---|---|---|---|---|---|---|---|---|---|
| | 1 | 2 | 3 | 4 | 5 | 6 | 1 | 2 | 3 |
| Rz | 3 | 3 | 7 | 8 | 0.5 | 1.2 | 3 | 0.4 | 8.2 |
| Friction Coefficient | 0.57 | 0.59 | 0.3 | 0.44 | 0.64 | 0.88 | 0.96 | 0.71 | 0.39 |
| Difference in SP Value | 0.2 | 0.1 | 0.2 | 0.2 | 0.2 | 0.2 | 2 | 0.2 | 0.2 |
| chlorination Rate | 22 | 29 | 22 | 22 | 22 | 22 | 0 | 22 | 22 |
| Surface State of Base Member | A | A | A | A | A | A | C | B-C | C |
| Adhesiveness | A | A | A | A | A | A | B | A | A |
| Image Quality (Moldability) | A | A | A | A | A | A | C | C | C |
| Charging Maintainability | A | A | A | A | B | B | C | C | B-C |

The foregoing description of the exemplary embodiments of the present invention has been provided, for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging roll comprising:

a cylindrical base member that has a metal-containing surface;

a conductive adhesive layer that includes a halogen atom-containing resin and has surface roughness Rz in a range of 0.5 μm to 8 μm on an outer peripheral surface side on the base member; and a conductive elastic layer that is disposed to be brought into contact with the outer peripheral surface of the conductive adhesive layer and includes a halogen atom-containing rubber.

2. The charging roll according to claim 1, wherein a friction coefficient on the outer peripheral surface side of the conductive adhesive layer is in a range of 0.4 to 0.7.

3. The charging roll according to claim 1, wherein the conductive adhesive layer contains a halogenated polypropylene polymer as the halogen atom-containing resin.

4. The charging roll according to claim 3, wherein a chlorinated polypropylene polymer is contained as the halogenated polypropylene polymer.

5. The charging roll according to claim 1, wherein the halogen atom-containing resin contains chlorine and has a chlorination rate in a range of 18% to 23%.

6. The charging roll, according to claim 1, wherein a difference in SP value between the halogen atom-containing resin and the halogen atom-containing rubber is 2 or less.

7. A charging unit comprising:

the charging roll according to claim 1.

8. A process cartridge that is detachable from an image forming apparatus, the cartridge comprising:

an image holding member; and a charging unit that charges the image holding member and includes the charging roll according to claim 1.

9. An image forming apparatus comprising:

an image holding member;

a charging unit that charges the image holding member and includes the charging roll according to claim 1;

a pressing member that presses the charging roll against the image holding member in a normal direction of a surface where the image holding member and the charging roll are brought into contact with each other;

a latent image forming unit that forms a latent image on the charged surface of the image holding member;

a developing unit that develops the latent image formed on the surface of the image holding member with a toner to form a toner image; and a transfer unit that transfers the toner image formed on the surface of the image holding member to a recording medium.

10. A method of manufacturing a charging roll, the method comprising:

forming a conductive adhesive layer that includes a halogen atom-containing resin and has surface roughness Rz in a range of 0.5 μm to 8 μm on an outer peripheral surface side on a cylindrical base member that has a metal-containing surface; and forming a conductive elastic layer that includes a halogen atom-containing rubber through extrusion molding so as to bring the conductive elastic layer into contact with the outer peripheral surface of the conductive adhesive layer.

11. The method of manufacturing a charging roll according to claim 10, wherein, a friction coefficient on the enter peripheral surface side of the conductive adhesive layer is in a range of 0.4 to 0.7.

12. The method of manufacturing a charging roll according to claim 10, wherein the conductive adhesive layer contains a halogenated polypropylene polymer as the halogen atom-containing resin.

13. The method of manufacturing a charging roll according to claim 12, wherein a chlorinated polypropylene polymer is contained as the halogenated polypropylene polymer.

14. The method of manufacturing a charging roll according to claim 10, wherein the halogen atom-containing resin contains chlorine and has a chlorination rate in a range of 18% to 23%.

15. The method of manufacturing a charging roll according to claim 10, wherein a difference in SP value between the halogen atom-containing resin and the halogen atom-containing rubber is 2 or less.

* * * * *